US006705052B1

(12) United States Patent
Larson

(10) Patent No.: US 6,705,052 B1
(45) Date of Patent: Mar. 16, 2004

(54) SOFFIT VENT

(75) Inventor: John A. Larson, Parkland, FL (US)

(73) Assignee: Plastic Components, Inc., Miami, FL (US)

( * ) Notice: Subject to any disclaimer, the term of this patent is extended or adjusted under 35 U.S.C. 154(b) by 0 days.

(21) Appl. No.: 10/126,230

(22) Filed: Apr. 18, 2002

(51) Int. Cl.[7] ..... E04D 13/00; E04B 1/00

(52) U.S. Cl. ..... 52/95; 52/96; 52/302.1; 52/741.1

(58) Field of Search ..... 52/95, 94, 96, 52/302.1, 741.1, 742.1, 742.12, 745.05, 750, 309.1, 518, 506.01, 561, 782.1, 783.1, 796.1, 302.3, 302.4

(56) References Cited

U.S. PATENT DOCUMENTS 3,204,374 A * 9/1965 Hellekson
3,777,649 A * 12/1973 Luckey ..... 52/94
4,007,672 A * 2/1977 Luckey ..... 98/37
4,195,455 A * 4/1980 Chalmers et al. ..... 52/94
5,195,283 A * 3/1993 MacLeod et al. ..... 52/95
5,243,793 A * 9/1993 MacLeod et al. ..... 52/95
5,414,965 A * 5/1995 Kelley et al. ..... 52/60
5,797,220 A * 8/1998 Zaccagni ..... 52/11
5,799,446 A * 9/1998 Tamlyn ..... 52/94
5,881,502 A * 3/1999 Tamlyn ..... 52/94
5,937,592 A * 8/1999 Tamlyn ..... 52/95
5,950,375 A * 9/1999 Zaccagni ..... 52/94
6,354,045 B1 * 3/2002 Boone et al. ..... 52/95

* cited by examiner

*Primary Examiner*—Jeanette Chapman

(57) ABSTRACT

A soffit vent comprising a base having opposing elongated edges, a pair of parallel flanges extending upwardly from the base intermediate the elongated edges and defining: 1) a vent zone in the base characterized by the presence of vent holes in the base; and 2) attachment flanges formed by portions of the base extending beyond the location of the parallel upwardly extending flanges, the attachment flanges including holes therein for the insertion of attachment devices. A method for installing the soffit vent of the present invention in an EIFS or DEFS structure comprising locating the soffit vent in the appropriate location between a pair of insulating members in the EIFS or DEFS structure, attaching the soffit vent to the structure by the insertion of a suitable fastener through the apertures in the attachment flanges and into the foam insulation.

2 Claims, 2 Drawing Sheets

SOFFIT VENT

FIELD OF THE INVENTION

The present invention relates to soffit vent devices and more particularly to soffit vents that are readily installable In existing exterior insulated finish systems (EIFS) and direct exterior finish systems (DEFS) structures.

BACKGROUND OF THE INVENTION

Soffit vents that can be installed in such applications are well known In the art. Generally such soffit vents comprise a channeled structure having longitudinally extending side walls that incorporate at their top outwardly and horizontally facing channels that are designed to engage foam insulating panels. The foam insulating panels are simply slid into such channels after location and fastening of the soffit vent In the appropriate location in the structure under construction.

Installation in existing buildings as a retrofit or repair is often difficult since access to the horizontally facing channels by the insulating foam panels is often impossible or difficult in such applications and consequently the exteriorly insulating foam cannot be slid into these channels, or conversely, the channels cannot be readily applied to the insulating foam.

Thus, there exists a need for a soffit vent for EIFS and DEFS construction that can be used for new construction or retrofitably installed in such systems without undue on site work or the destruction of some of the insulating material already in place.

OBJECTS OF THE INVENTION

It is therefore an object of the present invention to provide a soffit vent that is readily retrofitably installed in EIFS and DEFS building structures as well as new building structures.

SUMMARY OF THE INVENTION

According to the present invention there is provided a soffit vent comprising a base having opposing elongated edges, a pair of parallel flanges extending upwardly from the base intermediate the elongated edges and defining: 1) a vent zone in the base characterize by the presence of vent holes in the base; and 2) attachment flanges formed by portions of the base extending beyond the location of the parallel upwardly extending flanges, the attachment flanges including holes therein for the insertion of attachment devices. A method for installing the soffit vent of the present invention in an EIFS or DEFS structure comprising locating the soffit vent in the appropriate location between a pair of insulating members In the EIFS or DEFS structure, attaching the soffit vent to the structure by the insertion of a suitable fastener through the apertures in the attachment flanges and into the foam insulation.

DETAILED DESCRIPTION

Figure 1:
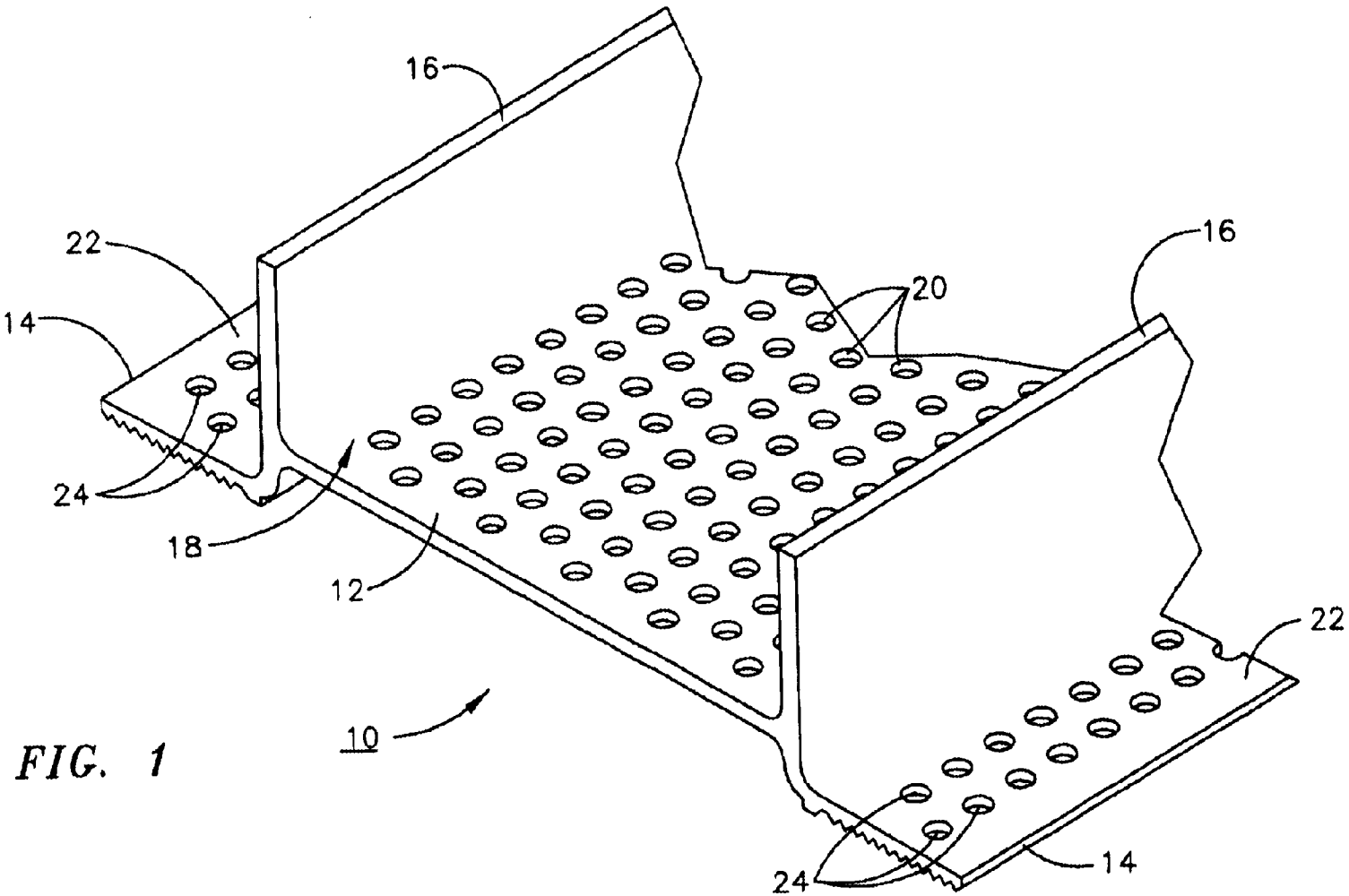
FIG. 1 is a perspective view of the soffit vent of the present invention.

Referring now to FIG. 1, the soffit vent 10 of the present invention comprises: a base 12 having opposing longitudinal parallel edges 14; a single or a pair of parallel flanges 16 extending upwardly from base 12 intermediate opposing edges 14 defining therebetween a vent zone 18 having vent holes 20 therein; and a pair of opposing parallel attachment flanges 22 having attachment device apertures 24 therein, are formed by the extensions of base 12 that extend beyond upwardly extending parallel flanges 16.

Figure 2:
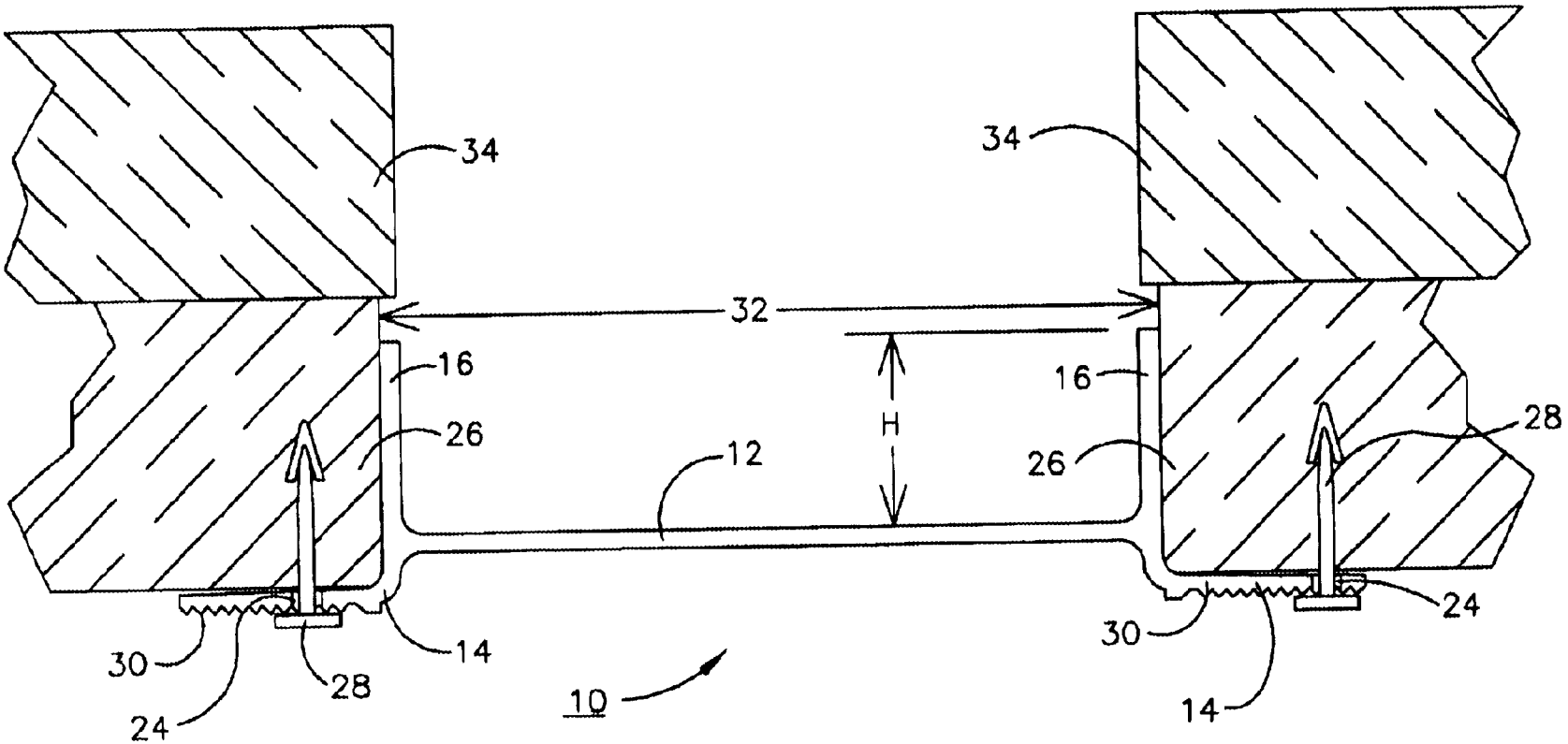
FIG. 2 is a cross-sectional view of the soffit vent of the present invention installed in an EIFS structure.

Referring now to FIG. 2, in the installed condition, soffit vent 10 is installed between two portions of exteriorly insulating foam 26 through the insertion of parallel flanges 16 therebetween. Although soffit vent 10 might be held in place through simple frictional engagement with insulating foam portions 26 it is advisable and apertures 24 in flanges 22 are provided for the insertion of fasteners such as the "arrow-shaped" locking device or Arro Lock® device 28 shown in FIG. 2, through two or more of apertures 24. The Arro Lock® devices are well known in the art and readily available to the installer of soffit vents of the type described herein. As also shown in FIG. 2, striations 30 may be provided in the event that some adherent material such as stucco is to be applied over flanges 24 for finishing purposes. In such common applications, the striations serve to provide an additional high surface area to which the overapplied finishing materials can adhere.

Soffit vent 10 may be fabricated from any suitable material such as plastic or metal, but readily extrudable plastic materials such as polyvinyl chloride (PVC), poly(ethylene) (PE), poly(propylene), etc are highly preferred for reasons of cost and ease of fabrication both at the fabricating factory site as well as the construction site.

In installation, exteriorly insulating foam 26 is applied to the structure in the 32 between two portions of insulating foam 26 is provided by cutting, location of foam sections 26 or otherwise. Soffit vent 10 is then inserted between foam portions 26 until seated against foam portions 26 as shown in FIG. 2. A suitable fasteners such as arrow-shaped devices 28 are then inserted through at least some of apertures 24 on both of flanges 22 and then into the body of foam 26 as also shown In FIG. 2. In this configuration, soffit vent 10 is fully installed and ready for the application of any overapplied finishing surface (not shown).

The successful use of soffit vent 10 of the present invention requires that the height H of flange 16 be at most about one half inch, as this is the minimum dimension of conventionally used exteriorly insulating foam panels of the type shown at 26 in FIG. 2. The supply of soffit vents 10 having a flange 16 greater than one half inch in height could, in some installations, result in interference between flanges 16 and overlying supports 34 for foam panels 26. In the installation shown in FIG. 2, the thickness of foam panels 26 is about three quarters of an inch while the height H of flanges 16 is one half inch.

There has thus been described a novel soffit vent suitable for retrofit installation in either EIFS or DEFS structures. The device is simple in structure and extremely easy to install in such constructions.

As will be apparent to the skilled artisan, a number of variations and modifications can be made to the structure described above without departing from the spirit and scope of the present invention. All such modifications and variations are clearly contemplated as being within the scope of the appended clams.

What is claimed is:

1. A method for the installation of a soffit vent in an exteriorly insulated structure having a soffit comprising:

J) attaching foam panels to the soffit of said structure;

III) providing an opening of suitable size in said foam panels;

III) inserting into said opening, a soffit vent comprising:

E) a base having opposing elongated edges;

F) a pair of longitudinal parallel flanges extending upwardly from the base at most one half inch and intermediate the elongated edges;

G) a vent zone in the base defined by said pair of parallel upwardly extending flanges;

H) vent holes in the base; and

E) attachment flanges formed by portions of the base extending beyond the longitudinal parallel upwardly extending flanges and having upper surfaces proximate said longitudinal upwardly extending flanges and lower surfaces, the attachment flanges including holes therein for the insertion of attachment devices and longitudinal striations in said lower surfaces;

IV) inserting the parallel upwardly extending flanges of the soffit vent into said opening; and securing said soffit vent in said opening by the insertion of suitable fasteners through said holes and into said foam panels.

2. The method of claim 1 wherein said fastener is arrow-shaped.

* * * * *